US007302220B2

(12) United States Patent
Chen et al.

(10) Patent No.: US 7,302,220 B2
(45) Date of Patent: Nov. 27, 2007

(54) FUSER ROLLER AND FUSING STATION

(75) Inventors: Jiann-Hsing Chen, Fairport, NY (US); Joseph A. Pavlisko, Pittsford, NY (US); Robert A. Lancaster, Hilton, NY (US); Nataly Boulatnikov, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 224 days.

(21) Appl. No.: 11/013,845

(22) Filed: Dec. 16, 2004

(65) Prior Publication Data

US 2005/0141935 A1 Jun. 30, 2005

Related U.S. Application Data

(60) Provisional application No. 60/531,922, filed on Dec. 23, 2003.

(51) Int. Cl.
*G03G 15/20* (2006.01)

(52) U.S. Cl. ..... 399/333; 219/216

(58) Field of Classification Search ..... 399/320, 399/328, 330, 331, 332, 333; 219/216, 616, 219/619; 432/60
See application file for complete search history.

(56) References Cited

U.S. PATENT DOCUMENTS

| | | | | |
|---|---|---|---|---|
| 6,355,352 | B1 | 3/2002 | Chen et al. | |
| 6,393,249 | B1 | 5/2002 | Aslam et al. | |
| 6,429,249 | B1 | 8/2002 | Chen et al. | |
| 6,582,222 | B1 * | 6/2003 | Chen et al. | 432/60 |
| 6,898,388 | B2 * | 5/2005 | Uehara et al. | 399/69 |

* cited by examiner

*Primary Examiner*—Hoan Tran
(74) *Attorney, Agent, or Firm*—Lawrence P. Kessler; Carl F. Ruoff

(57) ABSTRACT

This invention relates to an improved fuser roller for use in a high speed fusing station where improved heat transfer from the fuser roller to the fused substrates is required. The invention also relates to an improved fuser system using the improved fuser roller of the present invention in combination with an improved pressure roller to produce an improved fuser section.

26 Claims, 2 Drawing Sheets

FUSER ROLLER AND FUSING STATION

CROSS REFERENCE TO RELATED APPLICATION

Reference is made to and priority claimed from U.S. Provisional Application Ser. No. 60/531,922, filed Dec. 23, 2003, entitled AN IMPROVED FUSER ROLLER AND FUSING STATION.

FIELD OF THE INVENTION

This invention relates to an improved fuser roller for use in a high-speed electrophotographic fusing station wherein improved heat transfer from the fuser roller to the fused substrates is required. The invention also relates to an improved fuser system using the improved fuser roller of the present invention in combination with an improved pressure roller to produce an improved fuser section.

BACKGROUND OF THE INVENTION

Fusing stations for both black and white and color reproduction apparatus (electrophotographic copier/printers or the like) are well known. In view of the large number of copies required in today's businesses, higher speed reproduction apparatus are required. Typically in the lower speed reproduction apparatus, internal heaters have been used with the fuser rollers. A cushion layer that is typically more insulative than thermally conductive in nature has been used around an inner core of the roller.

It has been found that with high-speed reproduction apparatus, i.e., copy speeds of over 100 copies per minute, it is difficult to transfer the heat to the fuser roller at a rate effective to perform the fusing operation and it is difficult to supply the heat uniformly as the fusing operation proceeds. In other words, the heat removed from the roller to the substrate bearing the image to be fused is taken from the surface of the heater at a point referred to as a "nip" between the fuser roller and a pressure roller. It is difficult to maintain a uniform level of heat on the exterior of the fuser roller with the heat being removed at a variable rate in the nip.

Similar difficulties have been encountered with external heater rollers, which are typically anodized aluminum rollers, that are heated and in contact with the fuser roller. A primary difficulty is that the materials used heretofore to form the fuser roller have typically not been selected to have the thermal properties required to transfer the greater quantities of heat required and to permit transfer of the heat within the fuser rollers to maintain temperature uniformity consistent with long-term service with the roller and consistent with the thermal conductivities of many existing roller structures.

Accordingly a continuing search has been directed to the development of an improved fuser roller and an improved fusing system to ensure efficient heat transfer both into the fuser roller and through the layers of the fuser roller.

SUMMARY OF THE INVENTION

According to the present invention, an improved fuser roller for high-speed fusing operations is provided. The roller includes a rigid cylindrical core having an inside and an outside, at least one intermediate annular layer having an inside and an outside positioned around the outside of the core and including at least one of an annular base cushion layer, a heat distribution layer and a heat storage layer wherein each of the respective layers is adjusted to have a desired thermal conductivity and a desired range. An annular gloss control layer having an inside and an outside and a desired thermal conductivity and a desired range is positioned around the outside of the outer most intermediate layer.

The improved fuser system of the present invention provides: an electrophotographic copying process fusing station including a fuser roller having an outside with an annular gloss control layer of a polyfluorocarbon polymer or copolymer and having a thermal conductivity from about 0.05 to about 0.10 BTU/hr/ft/° F. and a range defined as the thermal conductivity of the annular gloss control layer divided by a thickness of the annular gloss control layer from about 312 to about 2500 BTU/hr/ft$^2$/° F., the fuser roller having a Shore A hardness from about 20 to about 60; and, a pressure roller having an outside coating of a polyfluorocarbon polymer or copolymer and positioned to form a nip from about 10 to about 25 millimeters in width between the pressure roller and the fuser roller, the pressure roller having a Shore A hardness from about 50 to about 70.

DESCRIPTION OF PREFERRED EMBODIMENTS

In the description of the figures, the same numbers will be used throughout to refer to the same or similar components.

Figure 1:
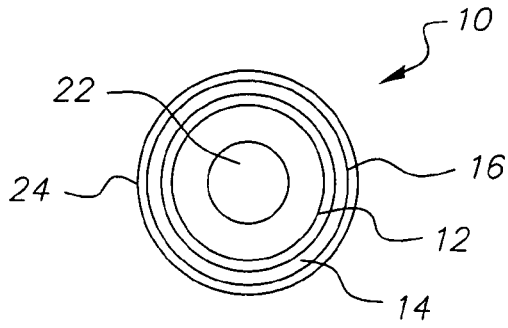
FIG. 1 is a schematic diagram of a fuser roller having a core and including an intermediate layer and a gloss control layer.

In FIG. 1, a roller configuration is shown which may be used for either the pressure roller or the fuser roller. This roller, as shown, includes an internal heater 22 as known to those skilled in the art. A rigid cylindrical core 12 is positioned inside the other layers of the roller. Core 12 is desirably metallic, although in instances where external heaters are used a rigid plastic could be used.

While not a preferred configuration, a suitably thermally conductive, thermally resistant plastic could be used for the core even when an internal heater is used.

In the construction of the fuser roller of the present invention, the cylindrical core 12 is positioned inside an intermediate layer 14 which may be selected from an annular base cushion layer, a heat distribution layer, and a heat storage layer. The outer layer 16 is a gloss control layer that is positioned outside the outermost intermediate layer. In certain embodiments, more than one intermediate layer may be used. To achieve the desired properties in the fuser roller, specific properties are required in the component layers.

The annular base cushion layer desirably has a thermal conductivity from about 0.25 to about 0.40 BTU/hr/ft/° F., a range from about 16.7 to about 250 BTU/hr/ft$^2$/° F. and a thickness from about 0.02 to about 0.2 inches.

The range is defined with respect to a particular layer as the thermal conductivity of the layer divided by the thickness of the layer.

The annular gloss control layer used as the outside of the fuser roller has a thermal conductivity from about 0.05 to about 0.10 BTU/hr/ft/° F., a range from about 312 to about 2500 BTU/hr/ft$^{2/}$° F. and a thickness from about 0.0005 to about 0.002 inches.

The heat distribution layer has a thermal conductivity from about 0.2 to about 0.4 BTU/hr/ft/° F., a range from about 1.3 to about 2500 BTU/hr/ft$^2$/° F. and a thickness from about 0.02 to about 0.2 inches.

The heat storage layer has a thermal conductivity from about 0.2 to about 0.4 BTU/hr/ft/° F., a range from about 1.3 to about 250 BTU/hr/ft$^2$/° F. and a thickness from about 0.02 to about 0.2 inches.

Some or all of these intermediate layers can be used in the fabrication of the improved fuser roller of the present invention. For instance, any one of the intermediate materials discussed above can be used as the intermediate layer 14 in FIG. 1. In all instances, the annular gloss control layer is positioned around the outside of the roller.

Figure 2:
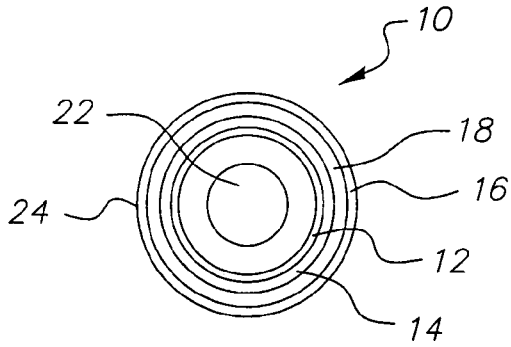
FIG. 2 is a schematic diagram of a fuser roller according to the present invention having a first intermediate layer and a second intermediate layer.

In FIG. 2, one or more of the intermediate layers can be used for either of layer 14 or layer 18. Desirably the annular base cushion is used inside the second intermediate layer, although the heat distribution layer and the heat storage layer can be used as a first and second intermediate layer. In this instance there is no annular base cushion layer and the heat distribution layer and the heat storage layer can be used as either the inner or the outer intermediate layer respectively.

Figure 3:
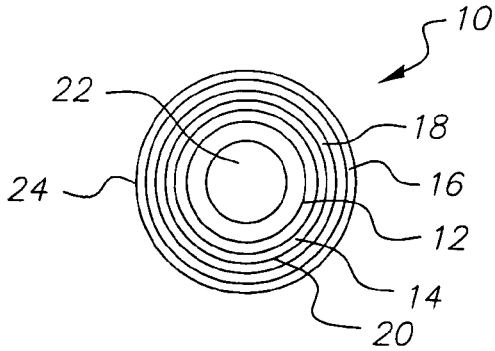
FIG. 3 is a schematic diagram of a fuser roller having a first intermediate layer, second intermediate layer and a third intermediate layer.

In FIG. 3, a third intermediate layer is shown.

The construction of the roller may be of any of the following configurations. The configurations are described below as the position of the layers moving outwardly from the core of the fuser roller:

the annular base cushion covered by an annular heat distribution layer covered by the gloss control layer;

the annular base cushion layer covered by the annular heat storage layer, which is covered by the annular heat distribution layer, which is covered by the gloss control layer;

the annular base cushion covered by the annular heat distribution layer, covered by the annular heat storage layer, covered by the gloss control layer;

the annular base cushion covered by the annular heat storage layer, covered by the gloss control layer;

the annular base cushion covered with the gloss control layer;

the annular heat distribution layer, covered by the gloss control-layer; and the annular heat storage layer covered by the gloss control layer.

The intermediate layers can be positioned as required to achieve the desired heat transfer to and from and within the fuser roller. Desirably the fuser roller has a Shore A hardness from 20 to about 60 and has a total thickness for all of the layers from about 0.00125 to about 0.2 inches. The fuser roller also has a release factor defined as the thickness of the fuser roller divided by the Shore A hardness of the fuser roller from about 1.04 to 10. Desirably the release factor is from about 2 to 10 and even more desirably from about 3 to about 4.5. Generally, the larger the number, the better the release. It is desirable for this application that the fuser roller be as soft and as thick as practical within the foregoing limits.

A wide variety of arrangements of the fuser roller layers are possible with the materials having the desired thermal conductivities and the desired ranges.

Typically the base cushion layer has a silicone rubber or silicone polymer having a low surface energy, such as di-methylsiloxane. The base cushion layer may also include fillers having inorganic particles such as metals, metal oxides, metal hydroxides, metal salts, mixtures thereof and the like. These fillers function to improve the thermal conductivity of the cushion layer. A preferred material is red rubber marketed under the trademark S5150 by Emerson & Cuming Microwave Products Inc., 28 York Avenue, Randolph, Mass. 02368. Another preferred base cushion material is marketed under the trade name of X-34-1190 and X-34-2405 by Shincor Silicones, Inc., 1030 Evans Avenue, Akron, Ohio 44305. Generally, materials known to the art for use as a base cushion material can be used as modified to have the desired thermal conductivity and the desired range values.

The heat storage layer typically includes from about 32 to about 37 volume percent (vol. %) aluminum oxide filler, from about 2 to about 6 vol. % iron oxide filler, and about 57 to about 66 vol. % polydinethylsolixane silicone rubber, such as EC-4952 red rubber sold by Emerson & Cuming Microwave Products Inc. Of the red rubbers marketed by Emerson & Cuming Microwave Products Inc., the red rubber marketed as EC-4952 is preferred.

The annular heat distribution layer typically includes a fluorocarbon thermoplastic random copolymer as disclosed in Chen et al., U.S. Pat. No. 6,429,249 (Chen et al.) and from about 1 to about 3 vol. % of zinc oxide filler, from about 5 to about 30 vol. % of tin oxide filler, from about 8 to about 15 vol. % of graphite filler and from about 3 to about 8 vol. % of polytetrafluoroethylene particles.

The gloss control layer typically includes the same polyfluorocarbon thermoplastic random polymers and copolymers used for the heat distribution layer. Particularly desirable results have been achieved with a copolymer of vinylideneflouride, tetrafluoroethylene, and hexafluoropropylene, as disclosed in Chen et al.

The materials from which the various layers are formulated are well known to those skilled in the art in general, although the tailoring of these materials to have the desired properties and the desired sequence of layers is not considered to be known to the art.

Of the formulations discussed above, the formulation of from about 1 to about 3 vol. % zinc oxide filler, from about 5 to about 8 vol. % tin oxide filler, from about 1 to about 5 vol. % polytetrafluoroethyl particles, and from about 0.1 to about 1 vol. % carbon filler is preferred. As indicated previously, the improved fuser roller of the present invention is to facilitate transfer heat from an internal heater to the exterior of the fuser roller. Clearly, this roller can also be used with external heaters or with both if desired.

Typically, the gloss of the gloss control layer, can be measured by a gloss measurement meter such as a Micro-TRI-Gloss 20-60-8J Glossmeter, which is manufactured by BYK-Gardener, USA of Rivers Park, Md. A suitable G60 gloss value for the gloss control layer is greater than 20, more preferably from about 20 to about 50, and most preferably from about 30 to about 40.

The improved roller is desirably used in a system that includes a fuser roller in conjunction with a pressure roller positioned to form a nip between the pressure roller and the fuser roller. Desirably, the nip is from about 10 to about 25 millimeters and preferably is about 18 millimeters. In the improved fuser system, it is desirable that a relatively soft fuser roller having a Shore A hardness from about 20 to about 60 be used. Desirably, the pressure roller is somewhat harder and has a Shore A hardness from about 50 to about 70. Usually the thickness of all the layers on the pressure roller will be from about 150 to about 200 millimeters. Further the pressure roller normally has a release factor from about 2.1 to about 4.0 and preferably from about 2.0 to about 3.0. The release factor is defined as a thickness of the pressure roller divided by a hardness of the pressure roller. Typically the pressure roller has a configuration similar to that shown in FIG. 1. Normally a base cushion material as described herein is used as intermediate layer 14 with the same gloss control material being used as the exterior layer as described above.

The particular base cushion material and gloss control layer are chosen to have properties within the ranges specified which results in the desired hardness and release factor. Use of the harder pressure roller in combination with the softer fuser roller has resulted in the efficient production of a high volume, i.e., over 100 copies per minute, of black and white and color copies. The fuser roller delivers sufficient heat and provides sufficient time for thermal relaxation between contact periods so that the fuser roller is stable and delivers sufficient heat uniformly to the substrates bearing the toner images to be fused.

Figure 4:
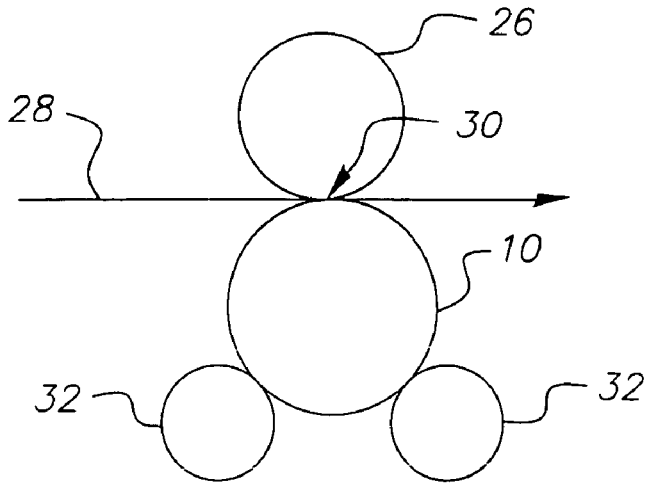
FIG. 4 is a schematic diagram of an embodiment of a fuser system of the present invention wherein external heaters are used to heat the fuser roller.

The system as shown in FIG. 4 includes a pressure roller 26, a fuser roller 10, external heaters 32, and a nip 30. Paper passes through nip 30 along a paper path shown generally as 28. The use of such fuser systems in the production of electrophotographic copies is well known to those skilled in the art and requires no discussion of the remaining details of the reproduction apparatus.

Figure 5:
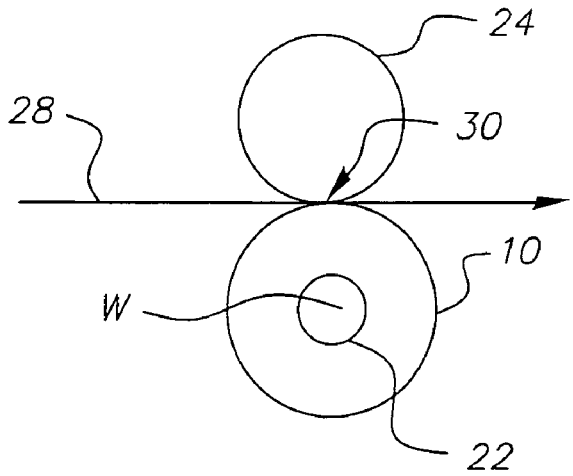
FIG. 5 is a schematic diagram of an improved fuser system wherein an internal heater is used to heat the fuser roller.

In FIG. 5, a similar system is shown with an internal heater.

By use of these systems, either with internal heaters, external heaters or with the heaters in combination, copies can be fused.

Prior art fuser rollers have typically been adequate for rapid fusing at less than about 100 copies per minute. The requirement of the ability to transmit with a fast enough thermal relaxation time, sufficient energy to fuse an initially cold receiver entering the fusing nip must be balanced by constraints on fuser roller stability such as cracking or shearing of the component layers of the fuser roller such as may be caused by too high a temperature close to the metal core for providing a required thermal gradient for heat to flow through the layers of an internally heated fuser roller.

As another example, the concentration of thermally conductive filler that provides a necessary high thermal conductivity of the layers cannot be made too high without compromising the compliance that is necessary to provide a wide fusing nip. Further concerns are related to the fact that many existing fuser rollers already contain filler concentrations near the allowable maximum.

Preferably, the fuser roller includes a six-inch outer diameter aluminum core coating with a base cushion layer 0.192 inches thick, which may be S5150 rubber obtained from Emerson & Cuming Microwave Products Inc. as noted above. Other materials, such as X-34-1190 and X-34-2405 rubbers marketed by Shincore Silicone, Inc., as noted above, could also be used. A heat storage layer about 0.008 inches thick made of EC-4592 also obtained from Emerson & Cuming Microwave Products Inc. is coated on a base cushion as a layer 0.0025 inches thick and made of a copolymer of vinylideneflouride, tetrafluoroethylene and hexafluoropropylene as described above.

A preferred pressure roller includes a 3.5 inch outer diameter aluminum core coated with a 0.200 inch thick thermally insulating layer of EC-4952 red rubber over coated with a gloss control layer about 0.0025 inches thick made of the same material as for the fuser roller. The key requirement for the materials for the thermal insulating layer is a Shore A hardness exceeding 50 and preferably having a value from about 50 to about 70. The preferred fuser nip between the fuser roller and the pressure roller is about 18 millimeters.

The tri-level structure of the fuser roller described above prevents unwanted heat loss from the heat storage layer to the metal core of the fuser roller. Moreover the heat storage layer has a sufficiently large thermal conductance to allow heat to spread quickly into an area where heat has been removed by a receiver member. The heat storage layer must have a sufficiently high heat capacity and yet not be so thick as to make the outer portion of the roller too stiff, which would have a negative effect on both nip width and the ability to release a fused substrate from the rollers.

The layers of the presently described roller are readily placed on the roller by conventional techniques as well known for the use of the red rubbers and for the polymers.

The present invention provides an improved fuser roller and by use of the fuser system discussed above, the present invention provides for an improved system that provides improved release geometry by using a soft fuser roller with a relatively much harder pressure roller.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A high-speed fuser roller having an outside and comprising:

a. a rigid cylindrical metallic core having an inside and an outside;

b. at least one intermediate annular layer, having an inside and an outside, positioned around the outside of the core and including an intermediate annular base cushion layer having an inside and an outside and having a thermal conductivity from about 0.25 to about 0.40 BTU/hr/ft/° F. and a range defined as the thermal conductivity of the annular base cushion layer divided by a thickness of the annular base cushion layer from about 16.7 to about 250 BTU/hr/ft$^2$/° F., and at least one of an annular a heat distribution layer and a heat storage layer; and c. an annular gloss control layer having an inside and an outside and positioned around the outside of an outermost intermediate layer.

2. The fuser roller of claim 1 wherein the annular base cushion layer has a thickness from about 0.020 to about 0.200 inches.

3. The fuser roller of claim 1 wherein the annular gloss control layer is positioned around the outside of the annular base cushion layer and has a thermal conductivity of about 0.10 to about 150 BTU/hr/ft/° F. and a range defined as the thermal conductivity of the annular gloss control layer divided by the thickness of the annular gloss control layer from about 312 to about 2500 BTU/hr/ft$^2$/° F.

4. The fuser roller of claim 3 wherein the annular gloss control layer has a thickness from about 0.0005 to about 0.002 inches.

5. The fuser roller of claim 1 wherein the intermediate annular layer is an annular heat distribution layer having an inside and an outside and having a thermal conductivity from about 0.2 to about 0.4 BTU/hr/ft/° F., a thickness from about 0.02 to about 0.2 inches, and a range defined as the thermal conductivity of the annular heat distribution layer divided by a thickness of the annular heat distribution layer from about 1.3 to about 2500 BTU/hr/ft$^2$/° F.

6. The fuser roller of claim 1 wherein the intermediate annular layer is a heat storage layer having an inside and an outside and having a thermal conductivity from about 0.2 to about 0.4 BTU/hr/ft/° F., a thickness from about 0.02 to about 0.2 inches, and a range defined as the thermal conductivity of the heat storage layer divided by a thickness of the heat storage layer from about 1.3 to about 250 BTU/hr/ft$^2$/° F.

7. The fuser roller of claim 6 wherein the annular gloss control layer is positioned around the outside of the heat storage layer and has a thermal conductivity of about 0.05 to about 0.10 BTU/hr/ft/° F. and a range defined as the thermal conductivity of the annular glass control layer divided by a thickness of the annular gloss control layer from about 312 to about 2500 BTU/hr/ft$^2$/° F.

8. The fuser roller of claim 1 wherein the intermediate annular layer includes:

a. an annular base cushion layer having an inside and an outside and having a thermal conductivity from about 0.25 to about 0.40 BTU/hr/ft/° F. and a range defined as the thermal conductivity of the annular base cushion layer divided by a thickness of the annular base cushion layer from about 16.7 to about 250 BTU/hr/ft$^2$/° F.;

b. an annular heat distribution layer having an inside and an outside, positioned around the outside of the annular base cushion layer, and having a range defined as a thermal conductivity of the annular heat distribution layer divided by the thickness of the annular heat distribution layer from about 1.3 to about 2500 BTU/hr/ft$^2$/° F.: and wherein the annular gloss control layer is positioned around the outside of the annular heat distribution layer and has a thermal conductivity of about 0.05 to about 0.10 BTU/hr/ft/° F. and a range defined as the thermal conductivity of the annular gloss control layer divided by the thickness of the annular gloss control layer from about 312 to about 2500 BTU/hr/ft$^2$/° F.

9. The roller of claim 8 wherein the fuser roller includes an annular heat storage layer positioned between the outside of the annular base cushion layer and the inside of the annular heat distribution layer, the annular heat storage area having a thermal conductivity from about 0.2 to about 0.4 BTU/hr/ft/° F. and a range defined as the thermal conductivity of the annular heat storage layer divided by a thickness of the annular storage layer from about 1.3 to about 250 BTU/hr/ft$^2$/° F.

10. The fuser roller of claim 1 said intermediate annular layer includes:

a. an annular base cushion layer having an inside and an outside and having a thermal conductivity from about 0.25 to about 0.40 BTU/hr/ft/° F. and a range defined as the thermal conductivity of the annular base cushion layer divided by the thickness of the annular base cushion layer from about 16.7 to about 250 BTU/hr/ft$^2$/° F.;

b. an annular heat storage layer having an inside and an outside, positioned around the outside of the annular base cushion layer, and having a range defined as a thermal conductivity of the annular heat storage layer divided by the thickness of the annular heat storage layer from about 1.3 to about 250 BTU/hr/ft/° F.; and wherein the annular gloss control layer is positioned around the outside of the annular heat storage layer and has a thermal conductivity of about 0.05 to about 0.10 BTU/hr/ft$^2$/° F. and a range defined as the thermal conductivity of the annular gloss control layer divided by the thickness of the annular gloss control layer from about 312 to about 2500 BTU/hr/ft$^2$/° F.

11. The fuser roller of claim 1 wherein the intermediate annular layer includes at least one of an annular heat distribution layer and an annular heat storage layer.

12. The fuser roller of claim 11 wherein the intermediate annular layer includes an annular heat storage layer having an inside and an outside and having a thermal conductivity from about 0.2 to about 0.4 BTU/hr/ft/° F. and a range defined as the thermal conductivity of the heat storage layer divided by a thickness of the heat storage layer from about 1.3 to about 250 BTU/hr/ft$^2$/° F.

13. The fuser roller of claim 11 wherein the intermediate annular layer is an annular heat distribution layer having an inside and an outside and having a thermal conductivity from about 0.2 to about 0.4 BTU/hr/ft/° F. and a range defined as the thermal conductivity of the annular heat distribution layer divided by a thickness of the annular heat distribution layer from about 1.3 to about 2500 BTU/hr/ft$^2$/° F.

14. The fuser roller of claim 11 wherein the intermediate annular layer is a heat storage layer positioned around the outside of the annular heat distribution layer having an inside and an outside and having a thermal conductivity from about 0.2 to about 0.4 BTU/hr/ft/° F. and a range defined as the thermal conductivity of the heat storage layer divided by a thickness of the heat storage layer from about 1.3 to about 250 BTU/hr/ft$^2$/° F.

15. The fuser roller of claim 1 wherein the fuser roller has a Shore A hardness from about 20 to about 60.

16. The fuser roller of claim 1 wherein the fuser roller has a release factor from about 1.04 to about 10.

17. The fuser roller of claim 16 wherein the release factor is from about 2 to about 10.

18. The fuser roller of claim 1 wherein the gloss control layer has a G-60 gloss value from at least 20.

19. An electrophotographic copying process fusing station comprising:

a. a fuser roller having an outside including an annular gloss control layer having a polyfluorocarbon polymer or copolymer and having a thermal conductivity from about 0.05 to about 0.10 BTU/hr/ft/° F. and a range defined as the thermal conductivity of the annular gloss control layer divided by a thickness of the annular gloss control layer from about 312 to about 2500 BTU/hr/ft$^2$/° F., the fuser roller having a Shore A hardness from about 20 to about 60; and b. a pressure roller having an outside coating of a polyfluorocarbon polymer or copolymer and positioned to form a nip from about 10 to about 25 millimeters in width between the pressure roller and the fuser roller, the pressure roller having a Shore A hardness from about 50 to about 70.

20. The fusing station of claim 19 wherein the fuser roller has a release factor from about 1.04 to about 10.

21. The fusing station of claim 20 wherein the fuser roller has a release factor from about 2 to about 10.

22. The fusing station of claim 19 wherein the pressure roller has a release factor from about 2.1 to about 4.0.

23. The fusing station of claim 22 wherein the pressure roller has a release factor from about 2.0 to about 3.0.

24. The fusing station of claim 19 wherein the fuser roller is softer than the pressure roller.

25. The fusing station of claim 19 wherein the fuser roller is heated by an internal heater.

26. The fusing station of claim 19 wherein the fuser roller is heated by at least one external heater.

* * * * *